United States Patent [19]

Austin

[11] Patent Number: 4,827,513

[45] Date of Patent: May 2, 1989

[54] COMMUNICATIONS SYSTEM

[75] Inventor: Kenneth Austin, Northwich, England

[73] Assignee: Advanced Electronic Products Limited, England

[21] Appl. No.: 729,534

[22] Filed: May 2, 1985

[30] Foreign Application Priority Data

May 5, 1984 [GB] United Kingdom ..... 8411599

[51] Int. Cl.[4] ..... H04K 1/04

[52] U.S. Cl. ..... 380/36; 380/28; 380/42

[58] Field of Search ..... 179/1.5 S, 1.5 R; 178/22.04, 22.06, 22.12; 380/28, 9, 36, 42

[56] References Cited

U.S. PATENT DOCUMENTS 4,221,931 9/1980 Seiler ..... 179/1.5 S 4,433,211 2/1984 McCalmont et al. ..... 179/1.5 S

*Primary Examiner*—Salvatore Cangialosi

*Attorney, Agent, or Firm*—Woodard, Emhardt, Naughton, Moriarty & McNett

[57] ABSTRACT

A communications scrambler operates on a digital basis in which digital or digitized incoming and outgoing signals are merged (60) into a single bit stream for application to a binary bit store (12) and retrieval therefrom for separation (62) of those signals. Multi-bit segments of each signal represent unintelligibly fragments of those signals and are stored and read-out under control of store addressing counters (36, 38, 76) whose outputs are selectively modified (48, 50) to achieve time-dispersion encryption/decryption for outgoing/incoming signals in multi-plexed writing and reading of the store (12). Digitization (52, 54) and reconstitution (64, 66) of analogue incoming and outgoing signals is provided using inherently digital on-chip circuitry and one-bit per sample at a high rate for easy interfacing in telephone/radio systems. The whole control system can be put onto a simple semiconductor chip of ULA type.

15 Claims, 2 Drawing Sheets

T.G. shown in low clock position

COMMUNICATIONS SYSTEM

The invention relates to communcation systems using so-called scrambling.

To date, scrambler systems can, we believe, be categorised in terms of:

(a) Rather simple and inexpensive systems that give rise to apparently unintelligible transmission signals, for example relying on frequency spectrum inversion which is readily reversed and offers little real security, particularly for two-way radio communication where there is often only a small number of allowed transmission frequencies.

(b) Very high security systems that are very difficult, if not virtually impossible, to decode, at least without recording and subsequent processing for analysis purposes. One such high security system of our own basic design is described in European patent application No. 83303100.8.

(c) Intermediate security systems that might yield to analysis of record messages, but do not become immediately intelligible by such simple processes as frequency spectrum inversion. A typical such system uses time-dispersion and relies effectively on breaking input signals up into segments too short to be intelligible in themselves and then re-ordering these segments for transmission purposes.

This invention is primarily concerned with category (c) scrambler systems and its principal objective is to provide encryption/description facilities at much reduced cost compared with customary implementations of time-dispersion techniques using analogue-type devices in so-called "bucket-brigade" systems with expensive control and signal conditioning circuitry, particularly filters, in order to interface with standard communications systems, such as radio, telephone and radiotelephone. Embodiments of this invention enable production cost reductions from hundreds of pounds sterling to tens or less.

Basically, we achieve that objective using digital techniques and solid-state semiconductor integrated circuits that are inherently of binary digital type operation in the form of read-write stores (RAMs) and semi-custom or configurable logic devices (ULAs), though full-custom chips could obviously be used.

According to the present invention an encryption/-decryption system for two-way communication purposes, comprises means for producing a single bit stream from binary digital signals corresponding to both directions of communication when present together, and means for storing and processing that single bit stream relative to encryption on a time-dispersion basis for multi-bit segments of each of its component signals corresponding to both directions of communcation, so as to achieve encryption of outgoing signals and decryption of incoming signals as separate signals.

Multiplexing incoming and outgoing digital signals to make the single serial stream is advantageously on a different basis from the sequenting for time dispersion purposes. We have successfully used bit-by-bit interleaving for the former and up to 2k bits per segment for the latter in relation to analogue signals sampled and digitised for encryption/decryption purposes on a delta modulation basis, i.e. one bit per sample, at a rate that is very high compared with the bandwidth of communication channels to be used, say approaching one hundred times mid-bandwidth as is readily available by dividing down from high frequency clock crystals readily available at least for television systems.

Use of such relatively very high sampling rates means that analogue signals for output purposes from the digital circuitry hereof substantially reduces, even eliminates, the requirements for additional high performance filters and/or other special signal conditioning circuitry made by prior time-dispersion systems, i.e. effectively requiring no more than the normal input/output interfacing provisions of existing narrow bandwidth communications systems.

Use of a single serial bit stream into and out of the store (RAM) gives great ecomomy in logic gate requirements for control purposes, and the processing to achieve and resolve time-dispersion of the multi-bit segments can be done according to patterns of addressing blocks of store space corresponding to said segments then written-to or read-out sequentially under counter control. Effectively, considering each incoming or outgoing signal relative to multi-segment (block) store space assigned thereto, that space will be filled and emptied on a cyclic basis, i.e. once per cycle or frame as we shall call it. The result will be that outgoing signals leave the store with their multi-bit segments shuffled for encryption purposes relative to the original signal, whereas incoming signals which are shuffled will leave the store unshuffled, i.e. decrypted.

As a particular example, using a 64K dynamic ram chip (DRAM) and a C-MOS type ULA with a $4MH_z$ plus TV clock crystal sampling rates for digitising analogue signals can be close to $300KH_z$ compared with a typical voice communication channel bandwidth of a basis $3KH_z$.

In the embodiment to be specifically described, such shuffling and unshuffling is done both at writing onto and reading from the store so that corresponding store spaces for frames of each incoming and outgoing signal are treated sequentially and non-sequentially (shuffle/unshuffle) for successive frames, which much simplifies logic control.

It will be appreciated that incoming and outgoing signals should be in synchronism frame-by-frame at each end and suitable synchronising can be done on the well-known "hand-shake" basis, preferably using pulse streams at a frequency compatible with the handwidth of the communication channel and predetermined both as to the number of constituent pulses and as to different widths of those pulses to facilitate identification of the last pulses of the streams. In case frames of incoming and outgoing signals are out of step, separate addressing means are preferably provided.

If the same pattern of shuffling is used from frame-to-frame, it will be obvious that the store spaces assigned to incoming and outgoing signals can be interleaved in the same manner as those signals are interleaved. However, we prefer that such patterns change from frame-to-frame, say on a pseudo-random basis, which means that communication channel delay can cause incoming and outgoing signals at each station to be subject to different frame patterns of encryption. Accordingly, we provide means responsive to synchronisation control for providing both such patterns as required, and for store spaces for the two signals to be distinct as they will need to be filled (or emptied) in different block orders. As there will be a need for control signals identifying incoming/outgoing signals, such control signals may be used directly as address bits of most significance for that purpose, as, indeed, can control signals for reading and writing in order to identify which is concerned of two halves of the store corresponding to time consecutive frames stored for continous operation. Such pattern variation can be made variable in itself by allowing for specific "seeding" of pseudo-random operations by code entry.

It is further preferred that frames of each signal are alternatively stored, and thus read-out, in up and down sequences of their corresponding block of store space, which improves unintelligible transmission of the encrypted signals.

Our preferred electronic analogue-to-digital and digital-to-analogue conversion has particular application where semiconducter circuitry involved is, or is generally considered to be, of inherently digital-type operation, for example as applies today for field-effect semiconductor integrated circuits, such as CMOS in which we are particularly interested as it affords fast switching and high-logic gate density with very low power consumption compared with other, usually bipolar, integrated circuit technologies some of which readily support analogue and digital circuit action on the same chip. We have found that digitisation of analogue signals is achievable within the normal voltage range/small current flow characteristics of CMOS integrated circuits and on the chips themselves by using a delta modulation technique to produce a serial bit stream, i.e. successive binary signal values at levels corresponding to '1' and '0' )and thus inherently digital), related to rising and falling amplitude excursions of analogue signals in a manner that allowed recovery of intelligible analogue signals.

In a preferred implementation, a digital two-state circuit is used that is of a type that provides an output, usually two complementary outputs, that or one of which follows a data input thereto, or its inverse, according to samples taken at intervals determined by a clock pulse input thereto, i.e. a circuit of generally accepted and used type and characteristics capable of present (and no doubt future) implementation in various ways using various component logic gates; and, for digitisation, applying analogue signals to the data input, and utilising those analogue signals, or signals related thereto, and said output, or a said output, preferably that one of two complementary outputs that is not used as the source of the desired output bit stream, in a mutually opposing or complementary manner in relation to content of an electrical energy storage element of a circuit having an integration function which will thus itself be related to and seek to follow the analogue signal applied at the data input, but all the while relative to other signals from said output resulting in leaving a faithfully coded replica of the input signal as a data stream from the two-state circuit.

Viewed against the background of conventional delta modulators of analogue type that use a sampling comparator for the analogue signal at one input and a signal at its other input that is incremented or decremented according to the comparator output and thus operates on a multiple or varying threshold basis, the present proposal can be seen as providing for operation effectively relative to a single threashold, as applies to digital circuitry, and making such provision using an integration-action circuit or element that effectively offsets the results of integrator action in anti-phase to the actual delta modulation signal and a tapped-off version of the actual analogue signal to be convered. There is then no problem in recovering a satisfactory emulation of the original analogue signal by simple integrator action controlled by the digital data bit stream.

One specific organisation of store and control logic achievable is now described, by way of example, with reference to the accompanying drawings, in which.

Figure 1:
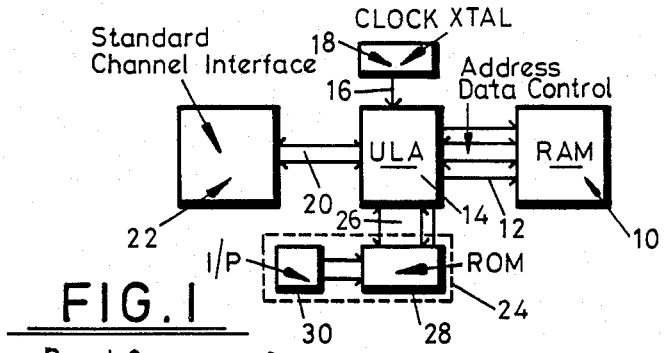
FIG. 1 is an overall block circuit diagram.

In FIG. 1, a store (RAM) 10 is shown connected at 12 to a semiconductor integrated circuit (say ULA) 14 for addressing, binary digital data flow, and control purposes. The circuit 14 is shown connected at 16 to a clock crystal 18 for receiving pulses at clock crystal frequency. The circuit 14 is also shown connected at 20 for two-way analogue signal (actually voice) passage to and from standard interfacing circuitry 22 for the communications equipment and channel concerned, e.g. telephone or two-way radio set.

Optional further circuitry is shown at 24 connected at 26 to the circuit 14. That further circuitry serves to vary encryption/decryption action by the circuit 14 and is shown as comprising a read only memory (ROM) 28, which maybe of a programmable type (PROM), and an input device 30 such as an operator-actuated key type device. The ROM 28 actually serves in a manner that will be better understood after the following description of the circuit 14, to provide information relating to addressing of the RAM 10.

Figure 2:
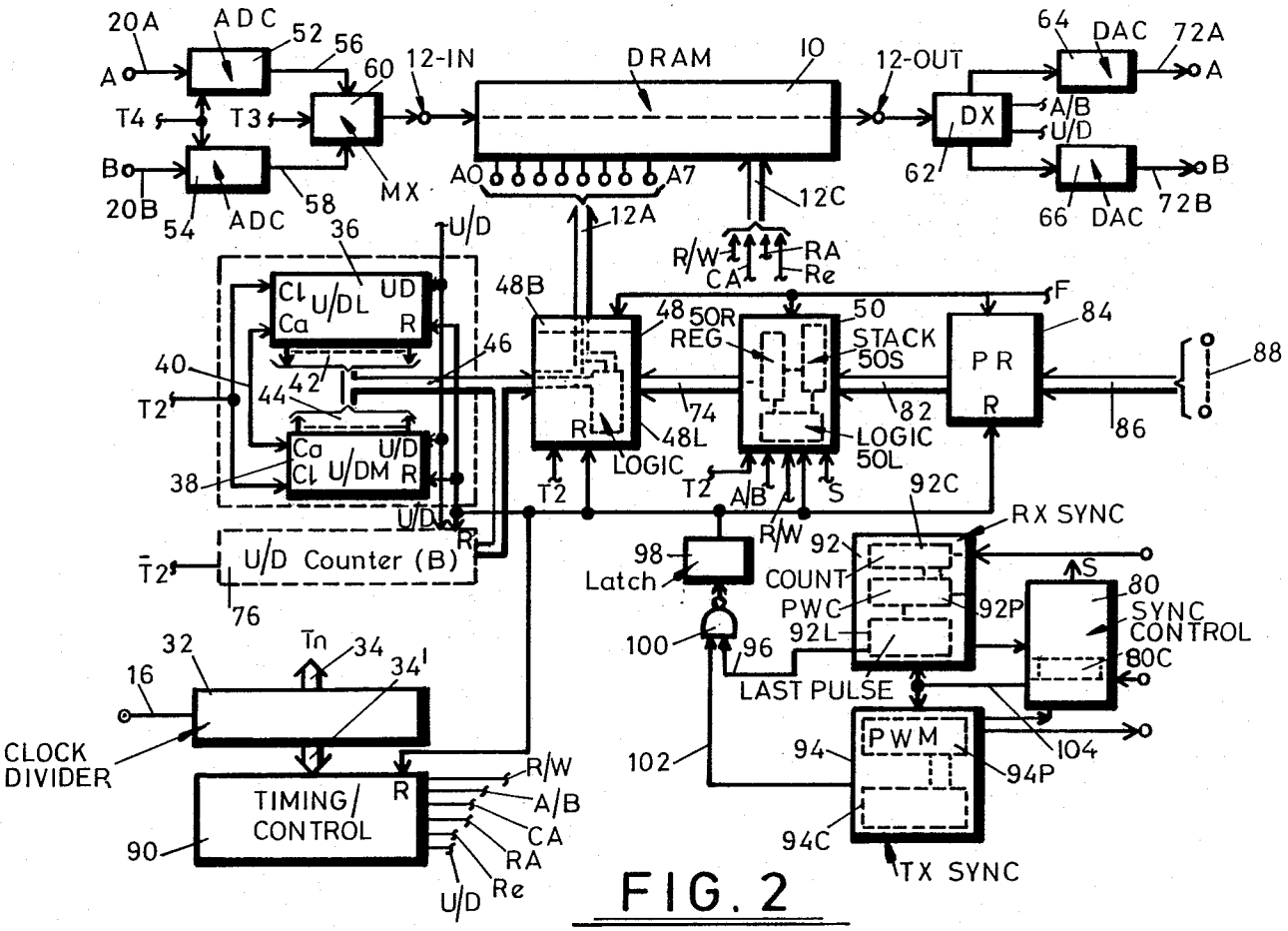
FIG. 2 shows the basic architecture of the control logic.

The ULA 14, further defined with reference to FIG. 2, has a master clock section 32 that is a divider for input 16 from the crystal clock 18. Using a standard 4–43 MHz T.V. crystal 18 (actually 4.433619 MHz), a 13-stage divider 32 enables ready acquisition of timing signals at its stage outputs 34 that halve down successively to about 1 KHz (actually 1.082426 KHz), selected such timing signals being used for control purposes of the circuit 14.

Data flow for the RAM 10 is shown at terminals 12-IN and 12-OUT with addressing information supplied on bus 12A to address terminals A0 to A7 for a 64 Kilobit RAM 14, actually a dynamic ram (DRAM). The DRAM used has eight-bit address inputs A0–A7 via which single bit addressing is achieved on a sequential row and column basis, as is well-known, and for which it needs read/write (R/W), column address (CA) and row address (RA) signals at 12C. The bus 12A passes outputs from fast counting means shown as two up/down counters 36 and 38, at least the least significant of which is of eight-bit type. Those counters 36, 38 have their carry terminals interconnected at 40 effectively to run as a single (up to 16 bit, but see below) counter as required to address each bit individually in the RAM 10. The counter outputs 42 and 44 go to a shared bus 46 and address modifier 48 to drive the address lines 12A. The outputs of counters 36 and 38 will be processed at 48 so to do on a segmental basis as above-mentioned according to outputs from segment controller 50.

Transmission uses analogue signals and analogue-to-digital converters are shown at 52, 54 for original information from a microphone or the like and from the transmission channel, shown on lines labelled 20A and 20B. The signals on lines 20A and 20B are best considered as two channels of information that are digitised at 52 and 54 in delta-modulation manner to provide serial stream of bit signals (suitably at about 277K-bit) on lines 56 and 58 that are fed to a multiplexer 60 which serves to interleave those bit streams and supply an effectively doubled frequency single bit stream (suitably 584K-bit) on line 12-IN. Suitable timing signals (T4) are available to control the digital-to-analogue converters 52, 54 from the fifth-least significant division stage of the clock divider 32, and (T3) to control the multiplexer from the fourth-least significant stage, i.e. from lines 34.

In generally similar manner for data read out from RAM 10, a single bit stream on line 12-OUT goes to a demultiplexer 62 and thence to digital-to-analogue converters 64 and 66 are required for signals to the transmission channel and to the associated headphones or speakers see lines 72A and 72B.

The address modifier 48 needs, at each addressing of the store 10, to generate the correct bit address, on the above mentioned row-then-column basis. It is assumed that segments will have a bit length greater than represented by the capacity of the least significant counter 36, which means that all necessary modifications take place relative to the outputs of the most significant counter 38, and simplifies control requirements. Those options for the present embodiment are basically whether or not to modify, with modification at writing-in or reading-out to encrypt an outgoing signal and to decrypt an incoming signal and no modification at reading-out and writing-in, respectively on an alternate basis from frame to frame and for incoming and outgoing messages simultaneously. That is conveniently achieved by logic 48L operative relative to those bits of the output of the most significant counter 38 that correspond to defining store space blocks equal to segment bit length and also to signals on lines 74 that define encrypting/decrypting patterns of blocks in a cyclic manner, i.e. frame-by-frame. Each frame obviously has a number of blocks equal the capacity of those bits, and eight or sixteen have been found to be satisfactory herein. Moreover, frames for incoming and outgoing signals are dealt with together on a multiplexed addressing basis, but will need different block patterns due to transmission delay if those patterns change from frame to frame as preferred herein. In fact, FIG. 2 shows a separate address counter system 76 to be operable out-of-phase with that 36, 38 and serve for incoming signals rather than outgoing signals in coping also with frames being out of step.

Nonetheless, reverting to the address modifier 48, it will have a set cycle of modification, or not, for interleaved writing-to and reading-out the store. In FIG. 2, that is done by making different digital words available from segment controller 50 on lines 74, one for no modification (e.g. all O's), one for outgoing signals, and one for incoming signals. Timing is conveniently at twice the rate of operation of the address counters and can be relative to an output buffer 48B for the lines 12A. Logic 48L can be a look-up table or active logic effective to correlate pattern input signals on lines 74 with corresponding actual address modifications as required.

The segment controller 50, can comprise suitable logic. For convenience, register means is indicated at 50R for applying the required signals to lines 74 under control of logic 50L responsive to read/write (R/W) and incoming/outgoing signal identification (A/B) control signals, and also serving to control loading of the register means from top and bottom of a stack 50S itself set by a synchronisation related signal (S). The latter signal is produced by synchronisation controller 80 as a number of frame intervals after a reset signal (R) that represents transmission delay after synchronisation is indicated. A succession of different pattern-designating signals is shown made available over lines 82 from a pseudo-random generator 84 itself capable of being "seeded" by input over lines 86 from input keys 88. The latter could be as labelled 30 in FIG. 1, in which case the ROM 28 could be a repertory for "seeding" of the pseudorandom generator 84, or a replacement therefor when it could, of course, constitute or be an alternative custom-designated pseudo-random generator.

It will also be appreciated that the A/B control signals to the segment controller will actually correspond to most significant bits of address-designating store spaces for encrypted/decrypted frames of signals and can be passed straight through to the address modifier 48 and thence to the lines 12A. Alternatively, they may be supplied only to the address modifier 48 with its logic 48L storing and making available from frame-to-frame the appropriate digital words. The U/D control signal, of course, corresponds to each filling of the address counters and controls output inversion gates.

Overall function and timing control is indicated at 90 with outputs therefrom for controlling up/down operation of the counters 36, 38, 76 (U/D), also shown going to the demultiplexer 62; for controlling reading/writing of the store 10 (R/W), also row (RA) and column (CA) addressing and refresh (re), and for determining incoming/ outgoing signal items of interleaved stored data (A/B). All such signals are readily derived with suitable delays from outputs of the clock divider 32, see 34.

The circuit 14 as thus described is able to control analogue-to-digital conversion and its reverse, multiplexing/demultiplexing of RAM 10 serial bit streams storage and reading thereof, and segmenting of the RAM relative to intelligible/unintelligible time-ordering of blocks of the overall bit stream, i.e. including the individual interleaved bit streams.

As mentioned above, it is, however, necessary for communicating equipment to be synchronised in relation to the operations so far described relative to the drawings. That is conveniently done using receive and transmit synchroniser circuitry 92, 94 to recognise and apply bursts of prescribed signals relative to the communication channel and controlled by synchronising controller 80. That can use one of the signals from divider 32 that is within the frequency characteristic of the channel (typically 3 KHz). The above-mentioned slowest signal at about 1 KHz (actually 1.082426 KHz) is preferred, i.e. from the most significant state of the divider 32. Accordingly, the transmit synchroniser 94 serves to apply a preset duration of such signal (0.118 seconds, i.e. 128 periods, being found suitable see counter 94C); and the receiver synchroniser 92 is arranged to actuate after receiving a lesser duration of such signal (96 consecutive periods being found suitable, see counter 92C), and then to detect the falling edge of the end of the received burst or tone (last period thereof see 92L) at which it provides an output on line 96 to latch circuitry 98 via NAND gate 100.

The latch 98 then serves, via its output (R), to reset the timer 90, the counters 36, 38, 76 and the segment control etc., and synchronisation is assured by reason of line 102 from the transmit synchroniser to the gate 100 that also causes the latch to reset the other end of the communication channel at the end of the synchronising tone. Should communication not actually be intelligible afterwards, or lose the unintelligibility, a forced reset can be made on line 104 from the synchronisation controller 80 to both of the transmit and receive synchronisers at that end to force a repeat of the synchronisation phase from either end of the channel. The synchronisers 92, 94 and latch 98 are, in fact, readily made to be reliant on a so-called "handshaking" protocol. To do so, the transmit synchroniser at the initiating end can repeatedly transmit spaced bursts of synchronising signal until an actual response is obtained from the intended receiving end, and only then do the latches activate their respective stations. It can further be useful to provide for a prescribed variation of duty cycles (pulse widths, see 94P) in the bursts of synchronising tone so that the receive synchroniser knows see pulse width calculation 92P where it is in the burst, at least at or near the end. Preferably, the synchronisation controller 80 includes a counter (80C) to limit the number of trials for synchronisation, say to three.

Reverting to the divider 32, it will be evident that the demultiplexer 62 and converters 64, 66 will need clock pulses similar to those applied to the multiplexer 60 and converter 52, 54. Appropriate lines are omitted from the drawing only in the interests of clarity.

Figure 3:
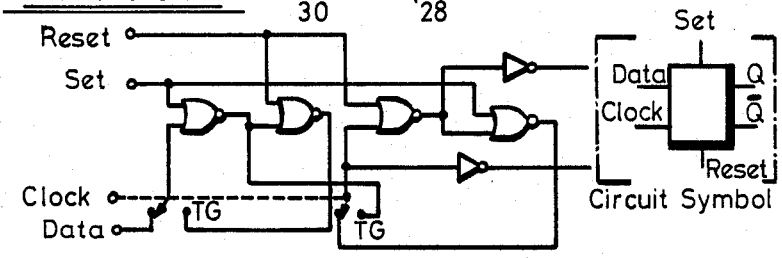
FIG. 3 shows a typical bistable circuit suited to implementing an integrated circuitry.
Figure 4:
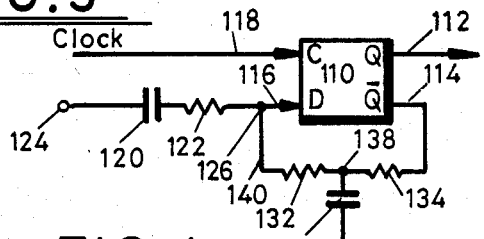
FIGS. 4 and 5 show preferred delta modulation circuitry.
Figure 5:
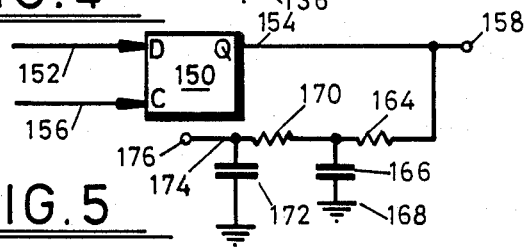

Turning to FIG. 3 logic diagram is given for a representative two-state, or bi-stable, circuit or flip flop as used generally throughout the circuit 14, including D-type bi-stable circuits 110 and 150 in FIGS. 4 and 5 for analogue-to-digital and digital-to-analogue conversion respectively.

In general, whilst we have indicated use of a single 64 K DRAM chip and 600-gate ULA chip plus television-type clock crystal of 4.43 MHz, whether all separate on a suitabke printed circuit board or to at least some extent embodied in hybrid or combined manner, leading to a multiplexed serial bit stream rate of 554 Kbits/-second corresponding to sample rates of 277 Kbits/-second/channel, it is to be understood that other bit stream and sampling rates could be used, perhaps lower enough to require some signal conditioning (e.g. filtering) for the communication channel concerned (or so requiring in any event because of higher channel bandwidth), but less than hitherto for analogue bucket brigade systems; and that other sizes and types of memory chips and/or logic control chips could be used, if desired more than one per scrambler system as same could well be justified in terms of costs relative to time-dispersion scramblers hitherto available, or may be convenient for particular design or device-availablility circumstances, say having a store for transmission and a store for reception.

Referring to FIG. 4, an analogue-to-digital converter, such as 52 and 54 in FIG. 2, has a D-type bistable circuit 110 (see also FIG. 3 for specific embodiment on-ship) has complementary outputs Q and $\overline{Q}$ from which data output and its complement are taken on lines 112 and 114, respectively, and data and clock inputs D and C for application of information signals and timing signals on lines 116 and 118, respectively. In normal use of such bistable circuits binary signal values at the data input D are effectively sampled at intervals determined by pulses at clock input C and the then-prevailing binary signal value appears at the Q output, with its opposite binary value at the $\overline{Q}$ output. Binary signal values, say low for binary '0' and high for binary '1', are effectively relatively to a threshold value for the bistable circuit 110, i.e. Q output low if D input below the threshold, or high if D input above the threshold.

D-type circuits 110 are used herein relative to an analogue input signal but normally within a larger integrated circuit, and normally afford access to the D input line 116 and the $\overline{Q}$ output line of the circuit 110 via pins for connection thereto of further illustrated components. Those further components include a coupling capacitior 120 and a resistor 122 in line 116 between analogue signal input terminal 124 and the D input of the bistable circuit 110 for passage of analogue signals, i.e. having information content represented by amplitude changes towards the circuit junction point 126. Then, digitisation of amplitude-significant analogue signals is relative to the single threshold value characteristic of the bistable circuit 110 and is achieved using the capacitior 130 and resistors 132, 134 connected basically in opposition relative to integration action.

Thus, the capacitior 130 is connected from between a low or ground reference 136 and a junction point 138 between the resistors 132 and 134. One of those resistors (132) is connected to the junction point 126 in branch line 140 therefrom, and the other resistor (134) is connected in the $\overline{Q}$ output line 114. As will be understood, the effect of an analogue signal at junction point 126 that is rising in amplitude will be to seek to charge the capacitor 130 through integrator action in the combination of the resistor 132 and the capacitor 130, i.e. the capacitor charge seeks to follow the rising analogue signal. However, at the same time, the combination of the resistor 134 and the capacitor 130, also connected for integrator action, receives the $\overline{Q}$ output of the bistable circuit 110, which, of course, can only be either high or low. Moreover, in the context of the desired delta modulation of the analogue signal (i.e. binary '1' signal levels at the Q output of the bistable circuit 110 whenever the analogue signal is rising), the $\overline{Q}$ output of the bistable circuit will be seeking to reduce the charge on the capacitor 130. The required effect of the resistors 132 and 134 is thus that, whenever the analogue signal is rising between clock pulses, the junction point 126 as seen by the D-input of the bistable circuit 110 will be above that circuits threshold value.

Contrastingly, when the analogue signal is falling, i.e. when the Q-output of the bistable circuit 110 is to be at binary 'O' level (low), the $\overline{Q}$-output of the bistable circuit 110 will be high and must have a sufficient effect, via resistor 134, on the capacitor 130 to drop the signal level at junction 126 as seen by the D-input of the bistable circuit 110 to a level below the threshld valve. We find that such effect is readily achieved.

Thus, taking the view that a rising analogue signal will always be seeking to increase the charge in the capacitor 130 and a low level at the $\overline{Q}$ output will seek to discharge the capacitor 130 so as effectively to limit the actual charge to correspond to signal levels above or below the threshold for the bistable circuit according to whether the analogue signal is rising or falling. Then, transistions of the analogue signal, going from falling to rising, will immediately raise the charge on the capacitor 130 over what corresponds to said threshold where it will stay andbe stable (for as long as the analogue signal is rising) despite and due to the effective discharge action of low $\overline{Q}$ signal levels, and, going from rising to falling, will immediately drop the charge on the capacitor 130 below what corresponds to said threshold where again it will stay and be stable (for as long as the analogue signal is falling) due to and despite the discharge blocking even charging action of high $\overline{Q}$ signal levels.

As required by delta modulation, any periods of constant analogue signal will result in alternating binary '1' and '0' signal levels from the Q-output of the bistable circuit 110 as the capacitor 130 "hunts" for an appropriate level of charge.

Reconstitution of analogue signals encoded by delta modulation in circuitry of FIG. 4 is readily achieved, again using integrator action relative to an off-chip capacitor with an associated resistor giving integrator action, for which each binary '1' will add a quantum of charge to the capacitor and each binary '0' will take-off a similar quantum of charge, resulting signals usually being further integrated to produce a smooth replica of the original signal.

FIG. 5 shows digital-to-analogue circuitry, such as 64 and 66 in FIG. 2, using another in-chip D-type bistable circuit 150, though now operating as no more than clock-sampled gate for a delta modulated bit stream on line 152 to its D-input to reproduce such signals on line 154 from its Q-output accurately timed by clock signals on line 156 to its C-input. The Q-output signal binary '1' or '0' levels on line 154 go off-chip at junction point 158 to a resistor 164 and thence via a capacitor 166 to low or ground reference at 168.

It will be appreciated that the capacitor 166 will increment its charge for each high value Q-output of the bistable circuit 150 and similarly decrement its charge for each low value of that Q-output. A further, but optional integrator comprised of resistor 170 and capacitor 172 is shown connected to the junction point 174 between the first resistor 164 and capacitor 166 to give a reconstituted analogue signal over line 174 at terminal 176.

It will be appreciated that further timing or other control signals can be applied, say via gates in the line 154, the whole circuit being suitable for (in fact derived from) one half of a system that demultiplexes interleaved data bit streams when, of course, another D-type bistable circuits, inverter gates and analogue restoration and straight integration stages will be provided for the second bit stream.

I claim:

1. Encryption/decryption system for two-way communication purposes, comprising means for producing first binary signals corresponding to incoming message signals; means for presenting second binary signals corresponding to outgoing message signals; means for combining said first and second binary signals, when present together, into a single bit stream; means for storing said single bit stream; and means for processing said single bit stream relative to encryption on a time-dispersion basis for multi-bit segments of said first and second binary signals, said means for processing being adapted to encrypt outgoing signals and decrypt incoming signals.

2. Encryption/decryption system according to claim 1, wherein said means for combining said binary signals into a single bit stream includes means for interleaving said first and second binary signals on a different basis from said time-dispersion basis.

3. Encryption/decryption system according to claim 2, comprising means for converting between said binary signals and corresponding analogue signals on the basis of one bit signal per sample.

4. Encryption/decryption system according to claim 3, wherein said combining of binary signals is alternation bit-by-bit.

5. Encryption/decryption system according to claim 3, having delta modulation analogue-to-digital conversion means comprising a bistable circuit capable of sampling a first signal at one input at intervals determined by signals at another input and providing bit outputs according to whether that first signal is above or below a threshold level, wherein the first signal is an analogue signal effectively offset against the results of applying an output signal to electrical energy storage means that seeks to follow excursions of the amplitude signal.

6. Encryption/decryption system according to claim 3, having delta modulation digital-to-analogue conversion means comprising a bistable circuit capable of sampling a first signal at one input at intervals determined by signals at another input and providing bit outputs according to whether the first signal is above or below a threshold level, wherein the first signal is delt modulation digital signal and an output signal is applied to electrical energy storage means that then produces an analogue signal with excursions following cumulating bit valves of the first signal.

7. Encryption/decryption system according to claim 3, comprising sampling control means having a sample rate that is very high compared with bandwidth of communication channles such as for telephone and two-way radio.

8. Encryption/decryption system according to claim 7, wherein the sampling rate is at least 100 times one-half of said bandwidth.

9. Encryption/decryption system according to claim 7, wherein the sampling control means comprises timing signals derived via a divider for a pulse train output from a clock crystal device.

10. Encryption/decryption system according to claim 1, comprising bit-addressable semi-conductor store means, and store addressing means utilising counter means for generating store adresses sequentially for store space assigned to each of sets of multi-bit segments constituting a frame, the store addressing means including address modifier means operative during each frame to designate encryption/decryption patterns of store space blocks corresponding to the multi-bit segments of each frame.

11. Encryption/decryption system according to claim 10, wherein the store addressing means produce store addresses for frames of incoming and outgoing signals on a multiplexed basis corresponding to their combination into the said singlee bit stream and for interleaved writing to and reading from the store means.

12. Encryption/decryption system according to claim 10, wherein the store addressing means further includes means for providing pattern defining signals that change from frame to frame.

13. Encryption/decryption system according to claim 11, wherein the pattern defining means comprises a pseudo random generator.

14. Encryption/decryption system according to claim 12, further comprising operator actuable means for providing the pseudo random generator with desired start signals.

15. Encryption/decryption system according to claim 9, wherein the store addressing means comprises separate counter means for frames of incoming and outgoing signals.

* * * * *